US009528680B2

(12) United States Patent
Zorn

(10) Patent No.: US 9,528,680 B2
(45) Date of Patent: Dec. 27, 2016

(54) LIGHT MODULE FOR A VEHICLE HEADLAMP

(71) Applicant: ZKW GROUP GMBH, Wieselburg An der Erlauf (AT)

(72) Inventor: Jürgen Zorn, Oberfucha (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 0 days.

(21) Appl. No.: 14/776,431

(22) PCT Filed: Mar. 5, 2014

(86) PCT No.: PCT/AT2014/050051
§ 371 (c)(1),
(2) Date: Sep. 14, 2015

(87) PCT Pub. No.: WO2014/138763
PCT Pub. Date: Sep. 18, 2014

(65) Prior Publication Data

US 2016/0040852 A1 Feb. 11, 2016

(30) Foreign Application Priority Data

Mar. 13, 2013 (AT) ..... A 50170/2013

(51) Int. Cl.
*F21S 8/10* (2006.01)
*F21W 101/10* (2006.01)

(52) U.S. Cl.
CPC ..... *F21S 48/328* (2013.01); *F21S 48/1104* (2013.01); *F21S 48/1159* (2013.01);
(Continued)

(58) Field of Classification Search
CPC .. F21S 48/328; F21S 48/1104; F21S 48/1158; F21S 48/13; F21S 48/1305
(Continued)

(56) References Cited

U.S. PATENT DOCUMENTS 8,092,058 B2 * 1/2012 Tatsukawa ..... F21S 48/1163 362/328
2012/0294024 A1 11/2012 Peck et al.
(Continued)

FOREIGN PATENT DOCUMENTS

DE 102007050893 A1 4/2009
DE 102010060642 A1 5/2012
(Continued)

OTHER PUBLICATIONS

International Search Report for PCT/AT2014/050051 dated Jun. 23, 2014.
Search Report for Austrian Patent Application No. A501702013.

*Primary Examiner* — Laura Tso
(74) *Attorney, Agent, or Firm* — Sutherland Asbill & Brennan LLP

(57) ABSTRACT

In the case of a light module (1) for a vehicle headlight, wherein the light module (1) has a heat sink (2) and a plurality of lighting units secured on the heat sink (2), each of the lighting units comprising at least one light source (5), a light source carrier (4) and a reflector unit (6) secured to the light source carrier (4), at least one lighting unit with the light source carrier rests rotatably on a horizontal supporting surface (3) of the heat sink (2).

15 Claims, 4 Drawing Sheets

Figure 1:
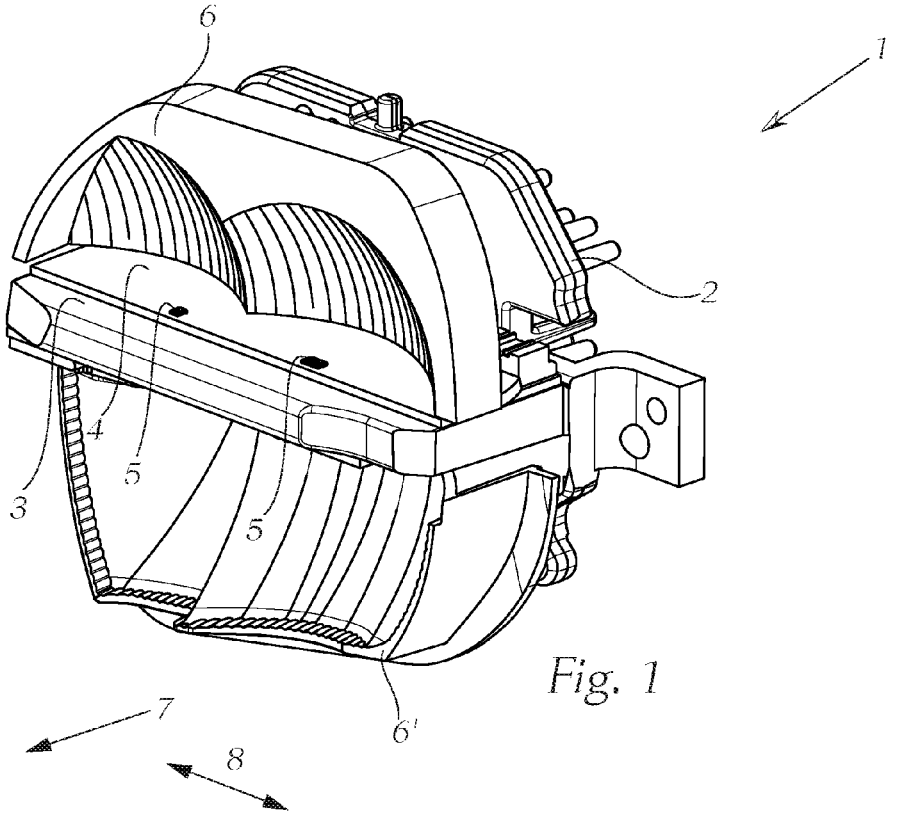

(52) U.S. Cl.
CPC ..... *F21S 48/13* (2013.01); *F21S 48/1305* (2013.01); *F21W 2101/10* (2013.01)

(58) Field of Classification Search
USPC ..... 362/516, 545, 285, 287, 289
See application file for complete search history.

(56) References Cited

U.S. PATENT DOCUMENTS

| | | | | |
|---|---|---|---|---|
| 2013/0051058 | A1 | 2/2013 | Bako et al. | |
| 2013/0051059 | A1 | 2/2013 | Abai et al. | |
| 2015/0308651 | A1* | 10/2015 | Herbers | B60Q 1/0683 362/516 |
| 2015/0369435 | A1* | 12/2015 | Bauer | F21S 48/115 362/545 |

FOREIGN PATENT DOCUMENTS

| | | | |
|---|---|---|---|
| EP | 2375142 | A2 | 10/2011 |
| WO | 2013032637 | A1 | 3/2013 |

* cited by examiner

LIGHT MODULE FOR A VEHICLE HEADLAMP

The invention relates to a light module for a vehicle headlight, wherein the light module has a heat sink and a plurality of lighting units secured on the heat sink, each of the lighting units comprising at least one light source, a light source carrier and a reflector unit secured to the light source carrier.

Modern vehicle headlights usually provide a plurality of light functions, such as dipped beam, main beam, partial main beam, daytime running beam, etc., wherein these functions are presented by a plurality of lighting units of a light module of a vehicle headlight. Legal requirements stipulate that the light cones emitted by the different light functions must be accurately adjusted to one another and positioned, which is understandable in particular in the case of functionalities such as partial main beam, which recently has become increasingly popular and in which case a powerful light field is projected at a height at which the oncoming traffic would undoubtedly be dazzled if the vertical light/dark boundary of this light function did not run precisely at a point from which a relatively high emission direction is permitted for an asymmetric dipped beam as well. Previously, the individual light functions were adjusted to one another with the aid of complex adjustment mechanisms, which each had to be intended for the hinged mounting of the individual lighting units, which of course increased the production and assembly effort of the light modules and therefore the cost of the vehicle headlight.

The problem addressed by the present invention is therefore that of creating a light module with which adjustment devices of this type for the coordination of the individual light functions with one another can be omitted, wherein however, in particular, the above-described particularly important pivotability of a lighting unit is to be ensured.

In order to solve this problem a light module of the type described in the introduction is developed in accordance with the invention such that at least one lighting unit with the light source carrier rests rotatably on a horizontal supporting surface of the heat sink. On the basis of the experience that, above all, the horizontal pivotability of at least one lighting unit of the light module is necessary in order to coordinate the light functions of a light module with one another, the inventors have taken the opportunity to dispense with the complicated adjustment mechanism and to use, as rotary plane for the horizontal pivotability, a surface of the heat sink provided anyway and extending horizontally in the installed position of the headlight. Heat sinks of this type are often used in modern high-power headlights or light modules in order to dissipate the heat which is produced by the light source and which occurs in a very concentrated manner over long periods of time, and are therefore in thermal contact with the light source carrier over more or less the entire surface. Due to the fixed connection between light source, light source carrier and reflector, these parts behave as a static unit, and therefore the light functions can be aligned with one another in a simple and reliable manner by suitable rotation in the horizontal plane on the surface of the heat sink. The omission of the adjustment mechanism has proven here not only to be economical, but also compact and stable, and therefore full functionality is attained with a particularly steady light exposure, even in the case of small headlights.

The present invention is used particularly effectively and advantageously when, in accordance with a preferred embodiment, the light source is formed by at least one LED and the light source carrier is formed by a circuit board. The use of LED technology in automotive engineering offers considerable advantages in view of overall size and associated design freedom, longevity of the light sources, and light yield, but necessarily requires the use of heat sinks for the circuit boards or printed circuit boards on which the LEDs are arranged, in order to dissipate the quantities of heat produced in a highly concentrated manner. In the installed position the supporting surface of the heat sink extends horizontally, and, since the LED is generally soldered flat onto the circuit board resting on the supporting surface, the LED radiates upwardly and to the side. The light is deflected in the emission direction by a suitably shaped reflector. The circuit board here lies flat on the supporting surface of the heat sink in order to achieve the most effective thermal contact and can be rotated in accordance with the invention.

In accordance with a preferred embodiment of the present invention the circuit board has a bore, which for rotatable mounting of the at least one lighting unit cooperates with a corresponding pin on the heat sink. This constitutes a simple solution for the problem of rotating the light source carrier on the heat sink about a defined axis.

In order to fix the rotary position once set, the invention is advantageously developed such that the light module comprises fixing screws for fixing the at least one rotatably securable lighting unit. Once the rotary position for coordinating the light functions with one another has been set, the setting can be ultimately secured with the aid of the fixing screws in accordance with this preferred embodiment of the invention.

An adhesive layer is preferably arranged between the heat sink and the light source carrier. An adhesive layer of this type is suitable on the one hand for ensuring the ultimate securing alternatively or additionally to the above-mentioned fixing screws, and on the other hand the heat transfer between the circuit board or the light source carrier and the heat sink can be improved with appropriate selection of the adhesive material.

In accordance with a further preferred embodiment of the present invention, the reflector unit is adhered to the light source carrier. In this case it is not necessary to connect the reflector unit to the light source carrier by screwing, which may lead to deformations of the reflector and therefore to an impairment of the light exposure on account of the pressure of the screws.

Figure 2:
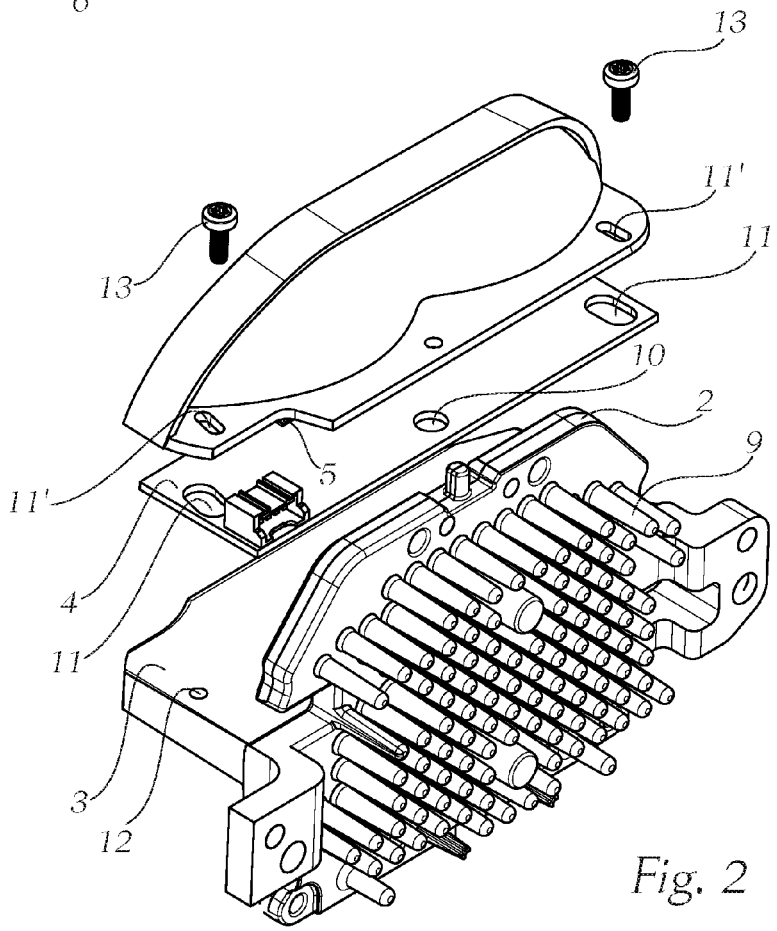
Figure 3:
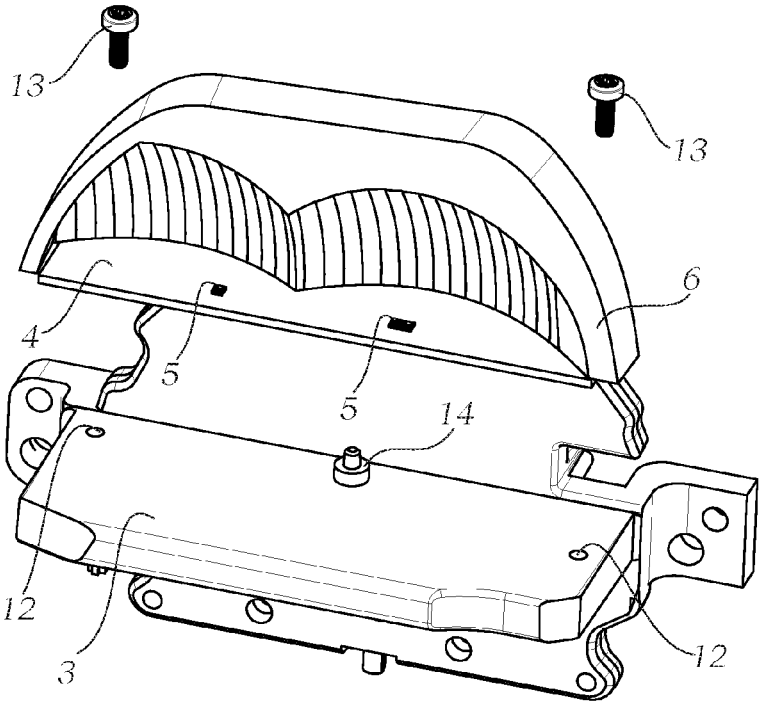
Figure 4:
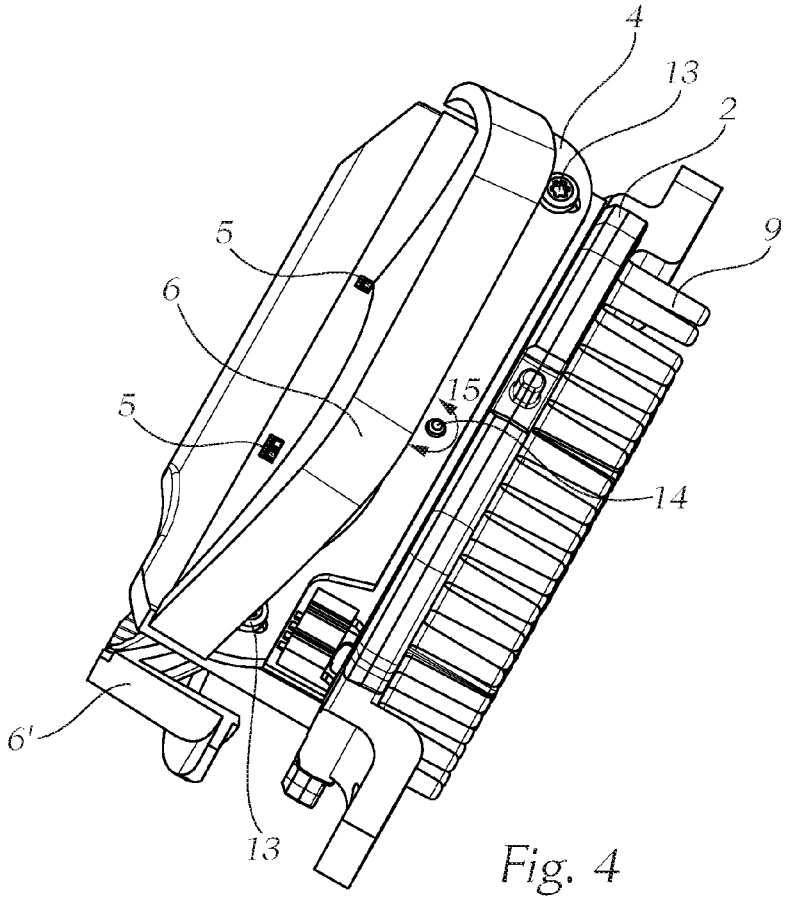
Figure 5:
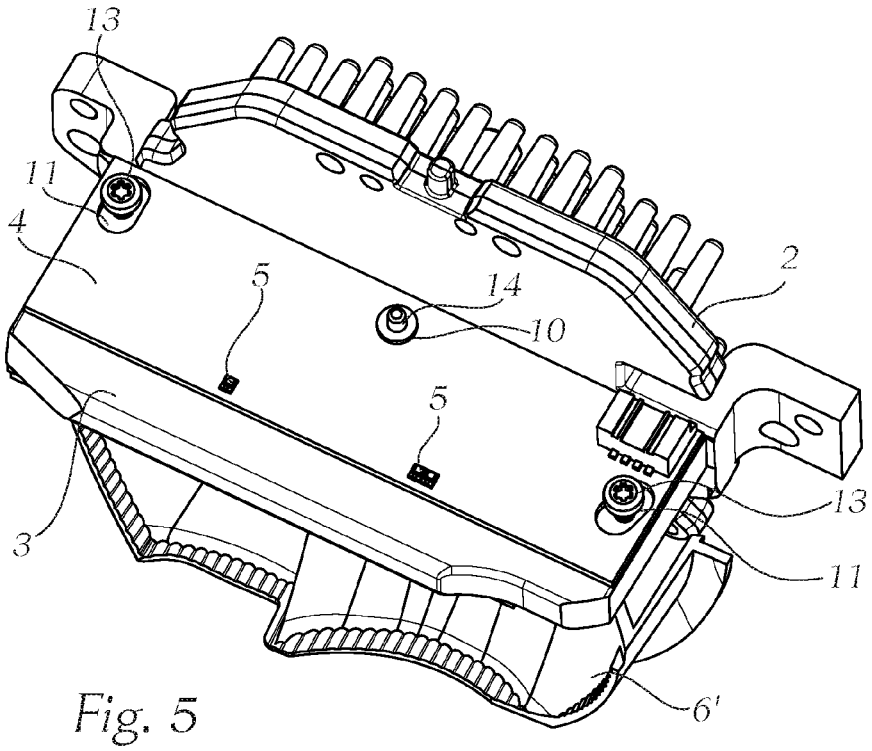
Figure 6:
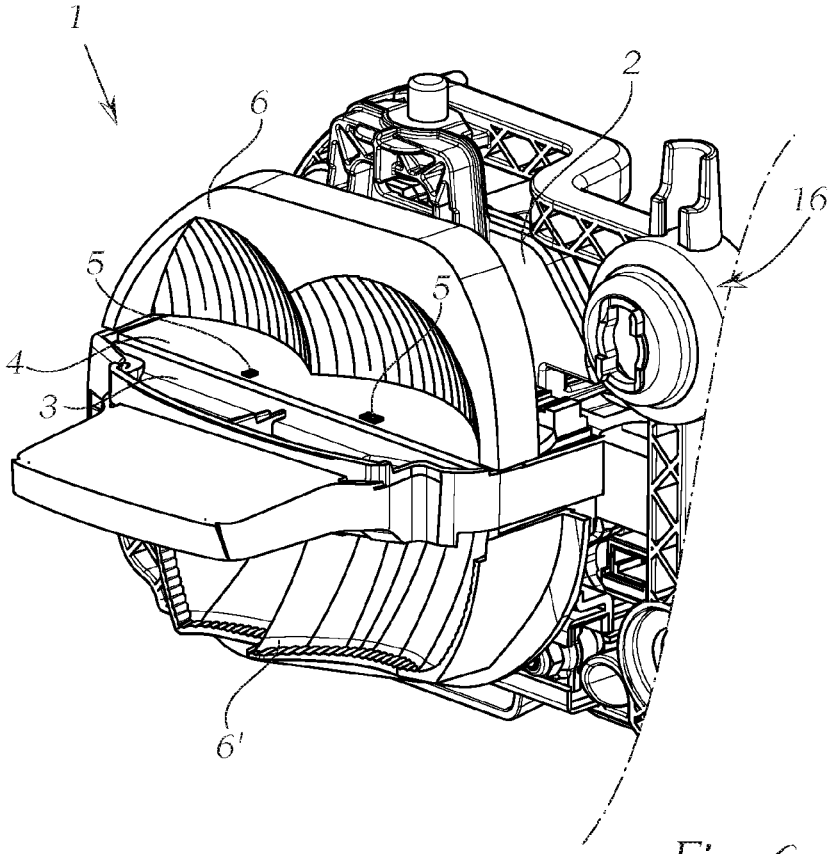
Figure 7:
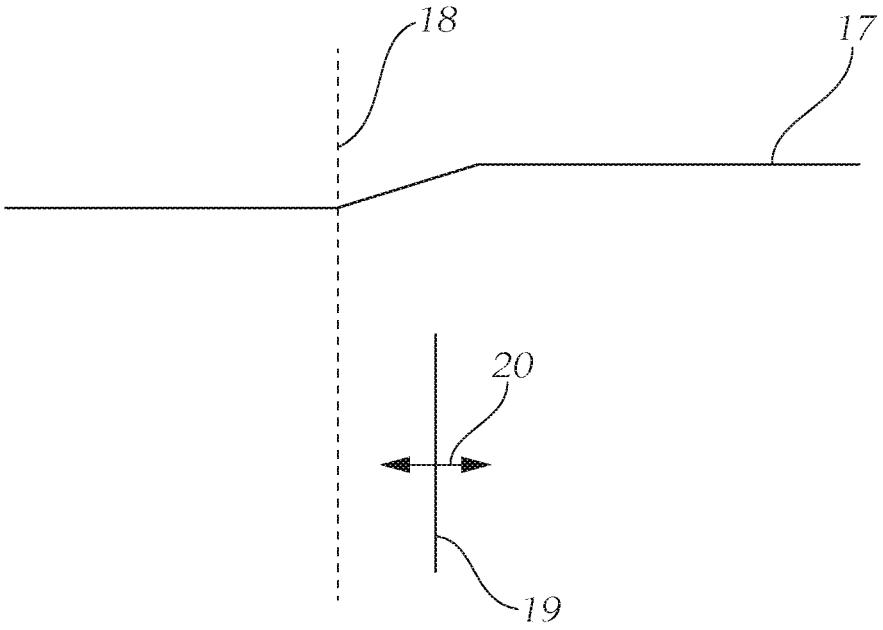

The invention will be explained in greater detail hereinafter on the basis of an exemplary embodiment illustrated in the drawing, in which FIG. 1 shows a perspective illustration of two lighting units on a heat sink of a light module according to the invention FIG. 2 shows a perspective partial exploded illustration of a lighting unit and of a heat sink of a light module according to the invention FIG. 3 shows a further perspective partial exploded illustration of a lighting unit and of a heat sink of a light module according to the invention FIG. 4 shows a perspective view of a lighting unit on a heat sink of a light module according to the invention FIG. 5 shows an illustration of a circuit board on a supporting surface of the heat sink of the light module according to the invention, FIG. 6 shows a perspective illustration of a light module according to the invention, and FIG. 7 shows a schematic illustration of the possibility for adjusting the light/dark boundary of a partial main beam.

In FIG. 1 a light module according to the invention is designated by 1 and is illustrated merely in part in FIG. 1. The light module 1 has a heat sink 2, which has a supporting surface designated by 3 for a circuit board or a light source carrier 4. The circuit board 4 carries the light sources or LEDs 5, of which the light is emitted from the reflector unit 6 in the direction symbolised by the arrow 7. It is clear that the supporting surface 3 in the state in which the light module 1 or the headlight (not illustrated in greater detail) is installed in the vehicle extends substantially horizontally, such that a rotation occurs in the plane of the supporting surface 3 in the direction of the double-headed arrow 8 to give a displacement of the light exposure emitted from the lighting unit in lateral directions symbolised by the double-headed arrow 8. The supporting surface 3 is arranged opposite a further supporting surface, on which a further circuit board with light sources and reflector unit 6' is arranged. For the purposes of the present invention it is sufficient if merely one lighting unit consisting of circuit board 4, light source or light sources 5 and reflector unit 6 is secured rotatably on the heat sink 2 or the supporting surface 3 of the heat sink 2, however it is also conceivable for all lighting units arranged on a heat sink 2 to be secured rotatably in this way.

In FIG. 2 it can be seen that the heat sink 2 on the side facing away from the supporting surface 3 has a multiplicity of cooling elements 9 in order to radiate the heat produced by the LEDs 5. The circuit board 4 has a bore 10, which cooperates with a pin (not illustrated in FIG. 2) in order to provide a rotatable secured connection on the heat sink 2. Reference sign 11 designates slots that can be aligned with bores 12 in the supporting surface 3 of the heat sink 2, such that the circuit board 4 can be fixed on the supporting surface 3 of the heat sink 2 with the aid of the fixing screws 13. Corresponding slots 11' are provided on the reflector unit 6. These slots 11', however, may be considerably enlarged in order to create a clearance for the heads of the fixing screws 13 when the reflector unit 6 is secured to the circuit board 4 by adhesive bonding.

In FIG. 3 the pin 14 can now be seen, which pin cooperates with the bore 10 visible in FIG. 2 for rotatable mounting of the circuit board 4. In the present example the reflector unit 6 is adhered to the circuit board 4.

In the illustration according to FIG. 4 it can be seen that only a relatively narrow gap is provided between the circuit board 4 and the heat sink 2, and therefore the rotatability in the direction of the double-headed arrow 15 is possible only to a relatively heavily restricted extent. This limited rotatability, however, is fully sufficient for the purposes of the present invention.

For further clarification, the circuit board 4 is illustrated in FIG. 5 in a secured position without the reflector unit 6. The circuit board 4 lies over its entire surface on the supporting surface 3 of the heat sink 2 in order to transfer the heat produced by the LEDs 5 to the heat sink 2. The slots 11 in the circuit board allow the rotary position of the circuit board 4 to be fixed in various rotary positions. The circuit board 4 is guided by the bore 10 and the pin 14 during the rotation.

FIG. 6 shows the light module according to the invention in a broader context and it can be seen particularly clearly that, compared with the supporting surface 3, a further supporting surface can be provided, on which a lighting unit as just described with circuit board, light sources and reflector unit 6' is secured rotatably or non-rotatably. For the purposes of the invention it is sufficient if only one lighting unit is rotatable relative to the other. Reference sign 16 designates a supporting frame for the light module 1.

The effect of the light module according to the invention with regard to the light exposure can be seen in FIG. 7. The line 17 constitutes a substantially horizontally running light/dark boundary of a dipped beam, wherein this light/dark boundary runs asymmetrically and rises from a region that is designated by the dashed line 18. A light/dark boundary of a partial main beam is illustrated by the line 19. In the case of the present invention the dipped beam is projected by the stationary reflector unit 6' illustrated in the previous figures. With the adjustment or coordination of the light module, the line 19 corresponding to the light/dark boundary of the partial main beam is displaced in the direction of the double-headed arrow 20 by means of the rotatability of the circuit board 4 on the supporting surface 3 of the heat sink 2, and therefore the line 19 can be brought into alignment for example with the line 18. With this adjustment a dazzling of the oncoming traffic is avoided, even with use of the partial main beam.

The invention claimed is:

1. A light module for a vehicle headlight, the light module comprising: a heat sink and a plurality of lighting units secured on the heat sink, each of the lighting units comprising at least one light source, a light source carrier and a reflector unit secured to the light source carrier, and the light source carrier (4) is formed by a circuit board (4), wherein the light source carrier of the at least one lighting unit rests rotatably on a horizontal supporting surface (3) of the heat sink (2).

2. The light module of claim 1, wherein the light source (5) is formed by at least one LED (5).

3. The light module of claim 2, wherein the circuit board (4) has a bore (10), which cooperates with a corresponding pin (14) on the heat sink (2) for rotatable mounting of the at least one lighting unit.

4. The light module of claim 1, wherein the light module (1) comprises fixing screws (13) for fixing the at least one rotatably securable lighting unit.

5. The light module of claim 1, further comprising an adhesive layer is arranged between the heat sink (2) and the light source carrier (4).

6. The light module of claim 1, wherein the reflector unit (6) is adhered to the light source carrier (4).

7. A light module for a vehicle headlight, the light module comprising: a heat sink and a plurality of lighting units secured on the heat sink, each of the lighting units comprising at least one light source, a light source carrier and a reflector unit secured to the light source carrier, wherein at least one lighting unit with the light source carrier rests rotatably on a horizontal supporting surface (3) of the heat sink (2), wherein the at least one light source (5) is formed by at least one LED (5) and the light source carrier (4) is formed by a circuit board (4), and wherein the circuit board (4) has a bore (10), which cooperates with a corresponding pin (14) on the heat sink (2) for rotatable mounting of the at least one lighting unit.

8. The light module of claim 7, wherein the light module (1) comprises fixing screws (13) for fixing the at least one rotatably securable lighting unit.

9. The light module of claim 7, further comprising an adhesive layer is arranged between the heat sink (2) and the light source carrier (4).

10. The light module of claim 7, wherein the reflector unit (6) is adhered to the light source carrier (4).

11. A light module for a vehicle headlight, the light module comprising:

a heat sink; and a lighting unit rotatably secured on a horizontal supporting surface of the heat sink, wherein the lighting unit comprises a light source, a light source carrier, and a reflector unit secured to the light source carrier, wherein the light source carrier has a bore that cooperates with a corresponding pin on the heat sink for rotatable mounting of the light source carrier on the horizontal supporting surface of the heat sink.

12. The light module of claim 11, wherein the light source is formed by at least one LED, and the light source carrier is formed by a circuit board.

13. The light module of claim 11, further comprising fixing screws for fixing the lighting unit.

14. The light module of claim 11, further comprising an adhesive layer disposed between the heat sink and the light source carrier.

15. The light module of claim 11, wherein the reflector unit is adhered to the light source carrier.

* * * * *